US006715162B2

(12) United States Patent
Han et al.

(10) Patent No.: US 6,715,162 B2
(45) Date of Patent: Apr. 6, 2004

(54) TOILET ASSEMBLY

(75) Inventors: Joseph Unkyung Han, Irvine, CA (US); Aleksandr V. Prokopenko, Bordentown, NJ (US); Robert Michael Jensen, East Brunswick, NJ (US)

(73) Assignee: American Standard Inc., Piscataway, NJ (US)

( * ) Notice: Subject to any disclaimer, the term of this patent is extended or adjusted under 35 U.S.C. 154(b) by 0 days.

(21) Appl. No.: 10/231,324

(22) Filed: Aug. 30, 2002

(65) Prior Publication Data

US 2004/0040076 A1 Mar. 4, 2004

(51) Int. Cl.[7] ..... E03D 1/34

(52) U.S. Cl. ..... 4/391; 4/415; 4/378; 4/379; 4/380

(58) Field of Search ..... 4/415, 300, 425, 4/420, 328, 378, 379, 380, 391

(56) References Cited

U.S. PATENT DOCUMENTS

| | | | | |
|---|---|---|---|---|
| 1,391,477 A | | 9/1921 | Hinsdale et al. | |
| 3,151,339 A | | 10/1964 | Chase | |
| 4,145,776 A | | 3/1979 | Crosby et al. | |
| 4,557,000 A | * | 12/1985 | Strangfeld | 4/324 |
| 4,604,763 A | | 8/1986 | Sprang | |
| 4,651,359 A | * | 3/1987 | Battle | 4/324 |
| 5,040,247 A | * | 8/1991 | Stevens | 4/324 |
| 5,054,133 A | | 10/1991 | Pickerrell et al. | |
| 5,170,515 A | | 12/1992 | Kai et al. | |
| 5,204,999 A | * | 4/1993 | Makita et al. | 4/300 |
| 5,216,761 A | * | 6/1993 | Isberg | 4/324 |
| 5,329,647 A | | 7/1994 | Condon | |
| 5,579,542 A | | 12/1996 | Hayman | |
| 5,694,652 A | | 12/1997 | Stock et al. | |
| 5,983,413 A | | 11/1999 | Hayashi et al. | |
| 6,145,138 A | | 11/2000 | Nakamura et al. | |
| 6,237,164 B1 | | 5/2001 | LaFontaine et al. | |
| 6,415,457 B2 | * | 7/2002 | Schmucki | 4/420 |

* cited by examiner

*Primary Examiner*—Henry Bennett
*Assistant Examiner*—Azadeh Kokabi
(74) *Attorney, Agent, or Firm*—Frommer Lawrence & Haug LLP; Matthew K. Ryan; Dennis M. Smid

(57) ABSTRACT

A toilet includes a toilet bowl assembly having a toilet bowl and a trapway extending from the bottom of the toilet bowl to a sewage line. The toilet bowl has a rim channel provided along an upper perimeter portion thereof. In this toilet, the flush water flows through the rim channel in a path which is asymmetric and unidirectional along the entire perimeter portion thereof. The rim channel includes a plurality of rim openings distributed evenly along the perimeter of the rim channel. Flush water passing through the plurality of rim openings pre-wets the entire perimeter of the toilet bowl. The rim channel further includes a pair of water discharge slots which directs water directly into the toilet bowl in two powerful streams. The flush valve allowing passage of water from the water tank to the toilet bowl assembly is in the form of a valve inlet having a radiused port to generate greater energy throughput of the flush water.

1 Claim, 17 Drawing Sheets

TOILET ASSEMBLY

FIELD OF INVENTION

The present invention relates to a toilet for the removal of human and other waste. The present invention further relates to a toilet which is resistant to clogging, increases flushing capacity, and delivers the flush water volume with greater energy.

BACKGROUND OF INVENTION

Toilets for removing waste products are well known. Typically, toilets incorporate three systems that work together to perform the flushing action. Those systems are (1) the bowl siphon, (2) the flush mechanism, and (3) the refill mechanism. Working in concert, these three systems allow for the flushing function of the toilet.

Siphoning is used to transport fluid and waste from the higher elevation of the bowl to a lower elevation of the wastewater line. The flow channels in a toilet assembly are designed to begin siphoning when the water in the bowl rises above a certain level. The siphon tube itself is an upside down U-shaped tube that draws water from the toilet bowl to the wastewater line. Water is drawn out of the bowl and into the siphon tube when the toilet is flushed. The flushing action is initiated by water entering the bowl through the action of the flush mechanism and the refill mechanism. When flushed, the bowl is quickly filled with water from the tank positioned above, which causes the siphon tube to fill with water, creating a pressure gradient in the tube. The water-filled bowl creates higher pressure at the beginning of the siphon tube, and causes the water and waste to be pushed through the tube and into the wastewater line.

Typically, the tank, positioned over the back of the bowl, contains water that is used to initiate the siphoning from the bowl to the sewage line, as well as refilling the bowl with fresh water. When a user desires to flush the toilet, he pushes down on a flush lever on the outside of the tank, which is connected on the inside of the tank to a movable chain or lever. When the flush lever is depressed, it moves a chain or lever on the inside of the tank which acts to lift and open the flush valve, causing water to flow from the tank and into the bowl, thus initiating the toilet flush.

In many toilet designs, water flows both directly into the bowl and is dispersed into the rim of the toilet bowl. The rim typically has several small holes to allow flow into the bowl. The water releases into the bowl rather quickly, with flow from the tank into the bowl typically lasting approximately two to four seconds. The water flows from the rim, down a channel within the sides of the bowl, into the large hole at the bottom of the toilet, commonly known as the siphon jet. The siphon jet releases most of the water into the siphon tube, initiating the siphon action. The siphoning action draws all the water and waste out of the bowl and into the siphon tube. The waste and water continues through the other end of the U-shaped siphon tube through an area known as the trapway, and is then released into the waste-water line connected at the base of the toilet.

Once the tank is emptied of its contents (fresh water) during the flush, the flush valve closes, and a floating mechanism, which has now dropped in the tank to some residual amount, initiates the opening of the filler valve. The filler valve provides fresh water to both the tank and the bowl through separate flows. Eventually the tank fills with water to a high enough level to cause the float to rise, thus shutting off the filler valve. At this point, the flushing cycle is complete.

However, government agencies have continually demanded that municipal water users reduce the amount of water they use. Much of the focus in recent years has been to reduce the water demand required by toilet flushing operations. In order to illustrate this point, the amount of water used in a toilet for each flush has gradually been reduced by governmental agencies from 7 gallons/flush (prior to the 1950's), to 5.5 gallons/flush (by the end of the 1960's), to 3.5 gallons/flush (in the 1980's). The National Energy Policy Act of 1995 now mandates that toilets sold in the United States can use water in an amount of only 1.6 gallons/flush (6 liters/flush).

In the past, toilet designs have attempted by various methods to comply with this reduced water requirement, but achieving superior flush performance has been difficult. Therefore, it has been found desirable to provide a toilet which assists the flush operation in meeting the mandated water requirements while at the same time providing for an enhanced and superior flushing operation.

In the crowded art of producing a more reliable, more efficient and more powerful 1.6 gallon (6 liter) gravity toilet, one method to more effectively remove waste from the toilet bowl is to increase the hydraulic energy available during the flushing operation. However, the hydraulic energy available is not enhanced by the typical rim wash employed in existing toilets as the water path flows in two opposite directions through the rim of the toilet thus reducing the available energy. It has therefore been found desirable to provide a toilet which increases the hydraulic energy of the rim flush.

Current agency requirements further mandate that the flush lever for the flush valve assembly have a minimum "hold down" time of 1 second without exceeding the aforementioned total water usage or discharge per flush of 1.6 gallons or 6 liters of water. It has been found that the hydraulic performance characteristics of the toilet can be significantly enhanced if water can be evacuated from the water tank in a dumping time of less than 1 second, preferably 0.5–0.6 seconds. Therefore, it has been further found desirable to provide a toilet which releases the effect of the flush lever so that the valve opening can close before the expiration of the mandated minimum "hold down" time of the flush lever (1 second) without exceeding the total water per flush mandate of 1.6 gallons (6 liters).

In the development of the invention of this application, several toilets were examined and tested. Measurements were made to examine flushing capabilities. In order to determine the clogging and unclogging properties of these toilets, various objects were flushed through the toilets, including ping pong balls, thick napkins, floating Polypropylene balls, foam sponges, and floating rubber tubes. These objects were used to simulate various waste sizes and shapes.

All of the tested designs shared some of the same problems, but in varying degrees. First, several of the models had clogging problems. In most of these toilets, this problem could be attributed to an undersized trapway. Second, when there was a significant level of waste in the bowl, several of the designs were not capable of cleaning the bowl in a single flush. Third, several of the toilets used a symmetrical sweeping flow path to deliver flow volume to the rim, which perhaps decreased the efficiency of the toilet. Fourth, the flush-valve in several of the toilets was not capable of providing both a fast and high volume of water delivery from the tank. Finally, many of the toilets produced a considerable amount of noise during flushing. These tests confirmed the desirability of providing a toilet assembly which achieves a maximum trapway but does not alleviate the siphon effect.

It is therefore desirable to provide a toilet which allows for quieter flushing and decreased likelihood of clogging, increases flushing capacity, and creates a vortex flushing action by having an asymmetrical jet stream rim flow. This toilet includes a flush valve which minimizes losses of hydraulic force and allows for smooth transition of the water flow from the flush valve to the jet and rim channel supplies.

OBJECTS AND SUMMARY OF THE INVENTION

Therefore, it is an advantage of the present invention to provide a toilet which avoids the aforementioned disadvantages of the prior art.

An additional advantage of the present invention is to provide a toilet that is resistant to clogging.

Another advantage of the present invention is to provide a toilet with a flushing mechanism which is capable of cleaning the bowl in a single flush.

A further advantage of the present invention is to create a toilet which is self-cleaning.

A still further advantage of the present invention is to provide a toilet with a relatively silent flushing mechanism.

A yet still further advantage of the present invention is to provide a toilet with a large trapway diameter.

Yet another advantage of the present invention is to provide a toilet with a high discharge rate into the wastewater line.

Still yet another advantage of the present invention is to provide a toilet which has a sweeping flow path to deliver the flush volume to the rim and jet sections with greater energy.

Yet an additional advantage of the present invention is to provide a toilet with a hydraulically tuned direct jet path for greater performance.

It is yet a further advantage of the present invention to provide a toilet which reduces hydraulic losses.

Still another advantage of the present invention is to provide a toilet having an asymmetrical rim path flow resulting in vigorous vortex action.

In accordance with the present invention, a new and improved toilet is provided which includes a toilet bowl assembly having a toilet bowl and a trapway extending from the bottom of the toilet bowl to a sewage line. The toilet bowl has a rim part along an upper perimeter portion that accommodates an asymmetric flow path for flush water. A water tank positioned over the toilet bowl assembly contains water that is used to initiate siphoning from the toilet bowl to the sewage line and refills the toilet bowl with fresh flush water after each flush operation.

This toilet incorporates water supply to the bowl from both a direct jet flow as well as an asymmetrical rim flow. The water flows from the tank through the rim in one direction and is dispersed through one slot halfway around the rim (at the front of the bowl) and another slot at the end of the rim's path (at the back of the bowl). The water also flows through several other smaller holes distributed evenly along the perimeter of the rim. The water discharged from the two large rim slots is in two powerful streams, thus creating a strong vortex that initiates the flushing action. This water discharge configuration creates a high energy jet. The dispersion from the smaller holes around the perimeter of the bowl serves to wet and clean the bowl.

This toilet includes a trapway with no reductions in cross sectional area. This feature prevents clogging, because any load passing through the trap continues through to the wastewater line. This trapway is also larger than existing trapways, which enhances the toilet's anti-clogging capacity. This increased trapway size also increases the waste discharge rate at the end of the system into the wastewater line.

Various other advantages, and features of the present invention will become readily apparent from the ensuing detailed description and the novel features will be particularly pointed out in the appended claims.

BRIEF DESCRIPTION OF THE DRAWINGS

The following detailed description, given by way of example, will best be understood in conjunction with the accompanying drawings in which.

DETAILED DESCRIPTION OF CERTAIN PREFERRED EMBODIMENTS

Figure 2:
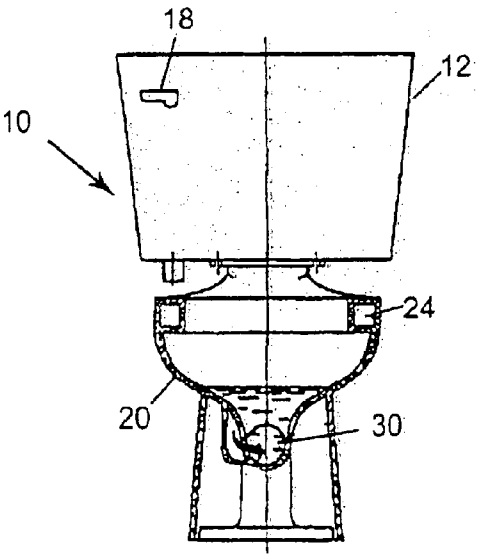
FIG. 2 is a front elevational view of the toilet of FIG. 1.
Figure 1:
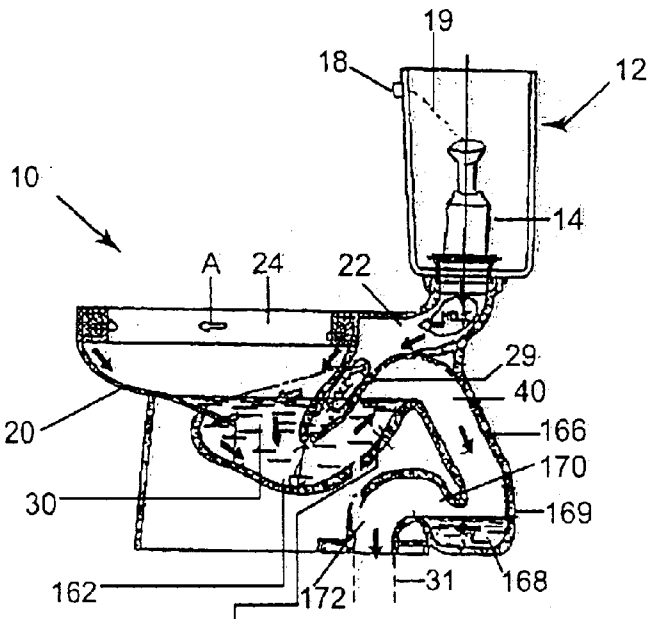
FIG. 1 is a side elevational view of a preferred embodiment of a toilet in accordance with the teachings of the present invention.
Figure 3:
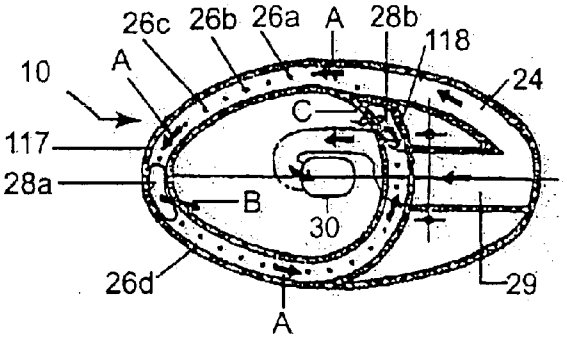
FIG. 3 is a top elevational view illustrating the flush water flow into the toilet bowl of the toilet of FIG. 1.

Referring now to FIGS. 1–3, a toilet tank in accordance with the teachings of the present invention is illustrated. As will be explained in more detail below, this toilet has a greater energy throughput of the flush water to thereby provide more energy available to remove waste from the toilet bowl. In addition, this toilet permits a toilet to meet governmental agency requirements which mandate a maximum water usage of 1.6 gallons (6 liters) per flush. Further, this toilet improves the flow characteristics of the flow water and flow capacity to provide for not only a more efficient flush but also enhanced cleaning performance and anti-clogging siphoning to assist in waste removal. Moreover, this toilet provides for a quieter and faster flush operation.

As shown in FIGS. 1–3, the toilet 10 includes a water tank 12 which includes a flush valve assembly 14. The water tank 12, which is positioned over the back of the toilet bowl 20, contains water that is used to initiate the siphoning from the bowl to the sewage line, as well as refilling the bowl with fresh water. When a user desires to flush the toilet, the user pushes down on a flush lever 18 on the outside of the water tank which is connected to the flush valve assembly 14 by a movable chain or lever 19. When the flush lever 18 is depressed, the chain or lever 19 acts to lift open the flush valve opening to be described hereinafter, causing water to flow from the tank 12 and into the toilet bowl 20 thus initiating the toilet flush.

In this toilet, the flush water passes from the water tank 12 to the toilet bowl 20 through a transition pathway 22, which as will be described in further detail below can be configured as a manifold made of plastic. This transition pathway 22 directs the flush water either into a rim channel 24 provided on top of the toilet bowl 20 or into a direct jet channel 29. As will be described in more detail below, the flush water flows through the rim channel 24 of the toilet in a path which is asymmetric and unidirectional (see arrows A of FIG. 3). This rim channel 24 includes a plurality of rim openings such as 26*a, b, c* and *d* distributed evenly along the perimeter of the rim channel 24 so that a portion of the flush water in the rim channel 24 flows therethrough and along the sides of the toilet bowl so as to pre-wet the entire perimeter of the toilet bowl and provide a side wall cleaning operation.

In order to increase the flush efficiency and performance of the toilet, a pair of water discharge slots 28*a* and 28*b* are provided in the rim channel 24 so that the flush water passing in the asymmetric path through the rim channel 24 can either be dispensed from the rim channel 24 into the toilet bowl through one of the plurality of rim openings, such as 26*a, b, c* and *d*, or through one of the pair of water discharge slots 28*a* and 28*b*. These water discharge slots 28*a*and 28*b* discharge flush water directly into the toilet bowl 20 in two water streams (see arrows B & C in FIG. 3) which create a strong vortex action to provide greater siphon energy for waste removal as will be described in greater detail below. As is shown in FIG. 3, one of the pair of water discharge slots 28*a* is provided about halfway around the rim channel 24 and the second of the water discharge slots 28*b* is provided at a back section 29 of the toilet bowl 20.

During the flush operation as described above, the water flows from the rim openings 26*a, b, c* and *d* down the sides of the bowl or directly into the toilet bowl 20 through the water discharge slots 28*a* and 28*b* toward the large discharge orifice 30 provided at the bottom of the toilet bowl 20 known as the siphon jet. Flush water is also delivered directly into the siphon jet by means of the direct jet channel 29. The siphon jet releases most of the water into the trapway 40 initiating a siphoning action. The siphoning action draws all the water and waste out of the toilet bowl and into the trapway 40 and is then released into the waste water line connected at the base 31 of the toilet 10.

Once the tank is emptied of its predetermined volume during the flush, the opening of a filler valve (not shown) is initiated. The filler valve provides fresh water to both the water tank 12 and the toilet bowl 20 through separate flows. Eventually the water tank 12 fills to a water lever to cause a float of the flush valve assembly 14 to rise, thus shutting off the filler valve. The flushing cycle is now completed.

A more detailed description of the components of the toilet 10 of the present invention follows.

Figure 5:
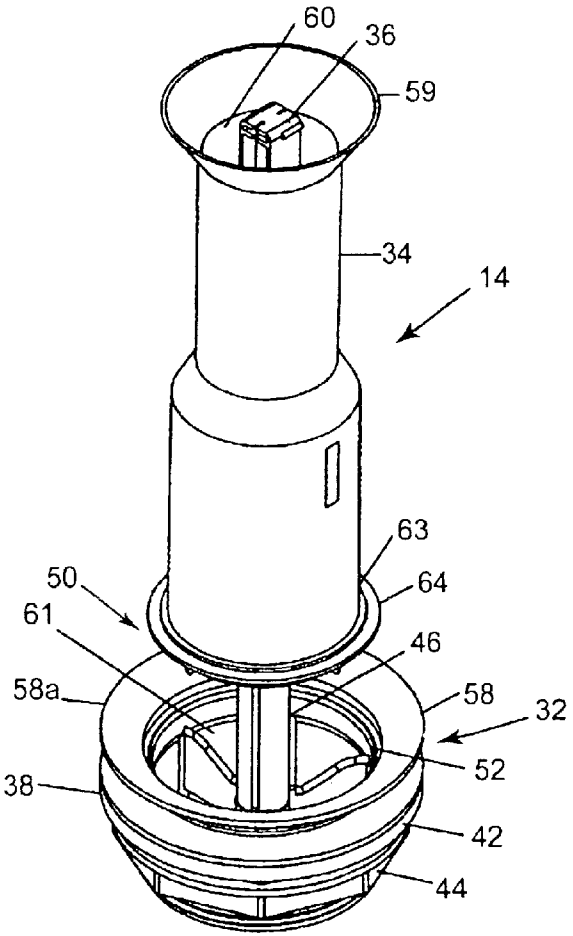
FIG. 5 is a front perspective view of the flush valve assembly of FIG. 4 with the valve opening in its open position.
Figure 4:
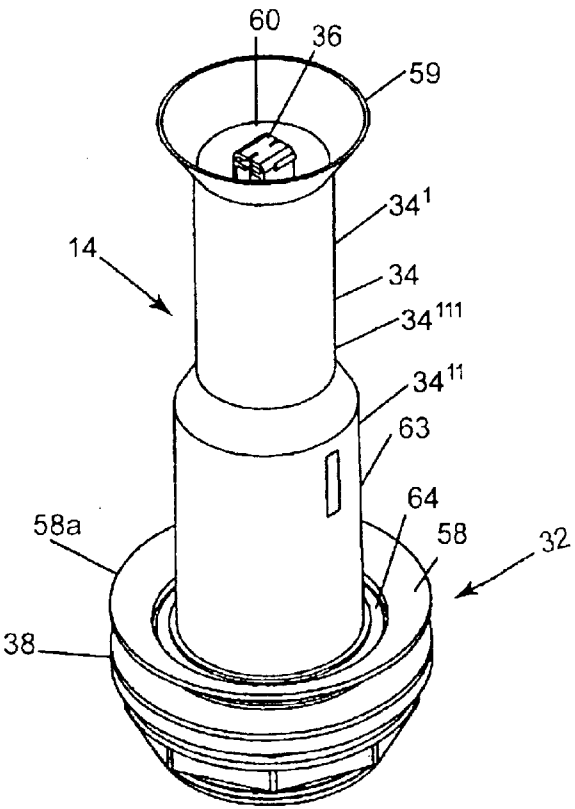
FIG. 4 is a front perspective view of a preferred embodiment of a flush valve assembly to be incorporated in the toilet of FIG. 1.
Figure 6:
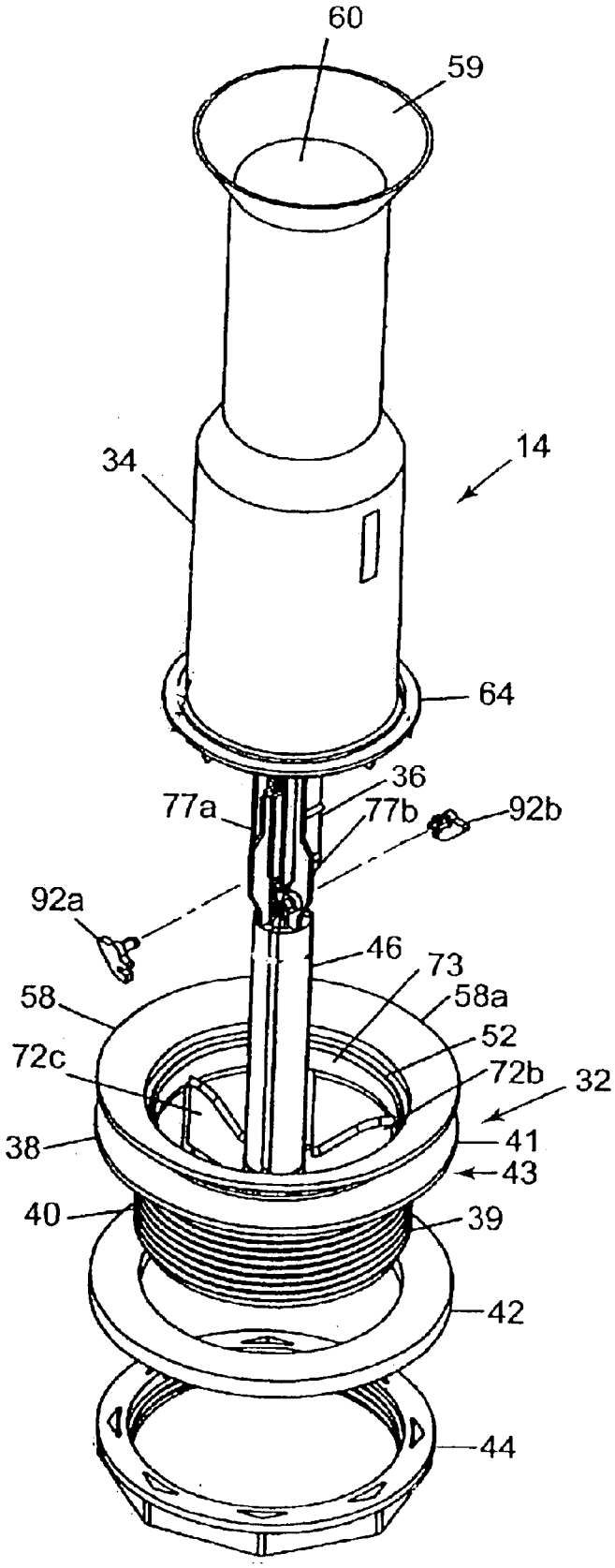
FIG. 6 is a front exploded view of the flush valve assembly of FIGS. 4–5.

As is shown in FIGS. 4 through 6, the flush valve assembly 14 of the present invention includes a valve body 32, a flush cover member 34 of a predetermined length, and a "trip-release" or "lost-motion" mechanism 36. The valve assembly 14 allows the water tank to which it is installed to hold a predetermined volume of water and to also serve as a conduit to deliver water to the toilet trapway via the passages within the toilet. The valve body 32 includes a base sleeve portion 38 which is secured to the water tank or water closet by a threaded member 39 provided along the outer peripheral surface 40 of a base support portion 41 thereof.

The valve body 32 also includes a first cylindrical tube member 46 which extends vertically from the base sleeve portion 38. In order to properly seal the valve body 32 to the water tank, a sealing member or washer 42 is fitted over the threaded member 39 so as to abut against an annular flange surface 43 of the base sleeve portion 38. A seal bearing 44 is threaded on the threaded member 39 so as to securely position the sealing member 42 between the annular flange member 43 and the sealing member 44.

The flush valve cover or closure component 34 is coaxially and slidably mounted with respect to the valve body 32 so that a valve opening 50 is created between the valve body 32 and the flush valve cover 34 when the flush valve cover 34 is removed from the valve body 32. The flush valve cover 34 is slidably movable between a first rest position, wherein the flush valve cover 34 is seated on an annular valve seat 52 of the base sleeve portion 38 of the valve body 32 so that water cannot pass through the valve opening 50 (see FIGS. 4 and 8), and a second position, wherein the flush valve cover 34 is removed from the annular valve seat 52 of the base sleeve portion 38 of the valve body 32 so that water can pass through the valve opening 50 (see FIGS. 5 and 9). The closed position of the valve opening 50 prevents the flow of flush water into the valve opening until the valve is activated, by means of a flush lever 18. The open position of the valve opening 50 allows the flow of flush water to enter the valve opening and proceed into passages within the toilet to which the water tank is attached.

As is set forth below, the flush valve assembly 14 of the present invention achieves a greater energy throughput of the flush water, which in turn generates more energy available to remove waste from the toilet bowl. In order to obtain this advantageous result, the base sleeve portion 38 of the vent tube includes a radiused inlet 58 which has a diameter a which is approximately 4.5 inches with a radius b of ¾" (see FIG. 7) incorporated onto the leading edge 58*a* of the inlet.

As a result, the radiused inlet 58 of the base sleeve portion 18 creates a discharge coefficient of the valve opening of 0.95. The discharge coefficient is the ratio between the actual flow area of the opening area and the static opening area. In practice, the higher the discharge coefficient of the opening, the greater the hydraulic energy of the water passing through the opening. Without providing a radiused inlet at the valve opening with a lead-in angle as in the present invention, the discharge coefficient of the typical prior valve opening is approximately 0.6. Accordingly, the throughput energy of the flush water passing through the valve opening of the flush valve assembly 14 of the toilet of the present invention is greater than the throughput energy of the flush water passing through existing valve assemblies of the prior art as discussed above. As a result of the radiused inlet 58 of the base sleeve portion 38 of the valve body 32 as described above, the flow characteristics of the flush water and flow capacity of the flush valve assembly incorporated in the toilet of the present invention are improved. Therefore, more energy is generated in the flush water passing through this flush valve assembly to remove waste in the toilet bowl.

In order to accommodate unrestricted overflow into the water tank, the flush valve cover 34 includes a funneled inlet 59 at the flush water inlet orifice 60. This funneled inlet has a predetermined lead-angle β to the horizontal axis of the flush valve cover (see FIG. 7).

As shown in the figures, especially FIG. 4, flush valve cover 34 may include an upper portion 34', a lower portion 34", and a portion 34'" located therebetween which may be a stepped or an inclined portion. The diameter of upper portion 34' may be smaller than the diameter of lower portion 34". Additionally, the annular sealing member 64 provided along the bottom surface of the flush valve cover 34 has a diameter which may be larger than that of the lower portion 34".

The inclined portion 34'" and the diameter of annular sealing member 64 may be designed and/or selected so as to enable a force to be exerted on the flush valve cover 34 during a filing operation which is sufficient to pull the flush valve cover 34 down and cause a proper seal to be formed. Such force may be the minimum force necessary to pull the flush valve cover 34 down and provide the proper seal. Additionally, the diameter of the lower portion 34" is selected so as to provide a desired buoyancy of the flush valve cover 34. Such buoyancy may affect the time period in which the flush valve cover 34 remains opened.

Thus, the flush valve cover 34 may provide a desired buoyancy and enable a minimum pulling force to be applied thereto while providing a proper sealing condition when the flush valve cover is moved to its first rest position. Furthermore, the flow characteristics of the flush water and flow capacity of the flush valve assembly 14 of the present invention are also enhanced by reducing the pulling force necessary to close and properly seal the valve opening 50 when the flush valve cover 34 is moved from its second upper position to its first rest position.

Figure 7:
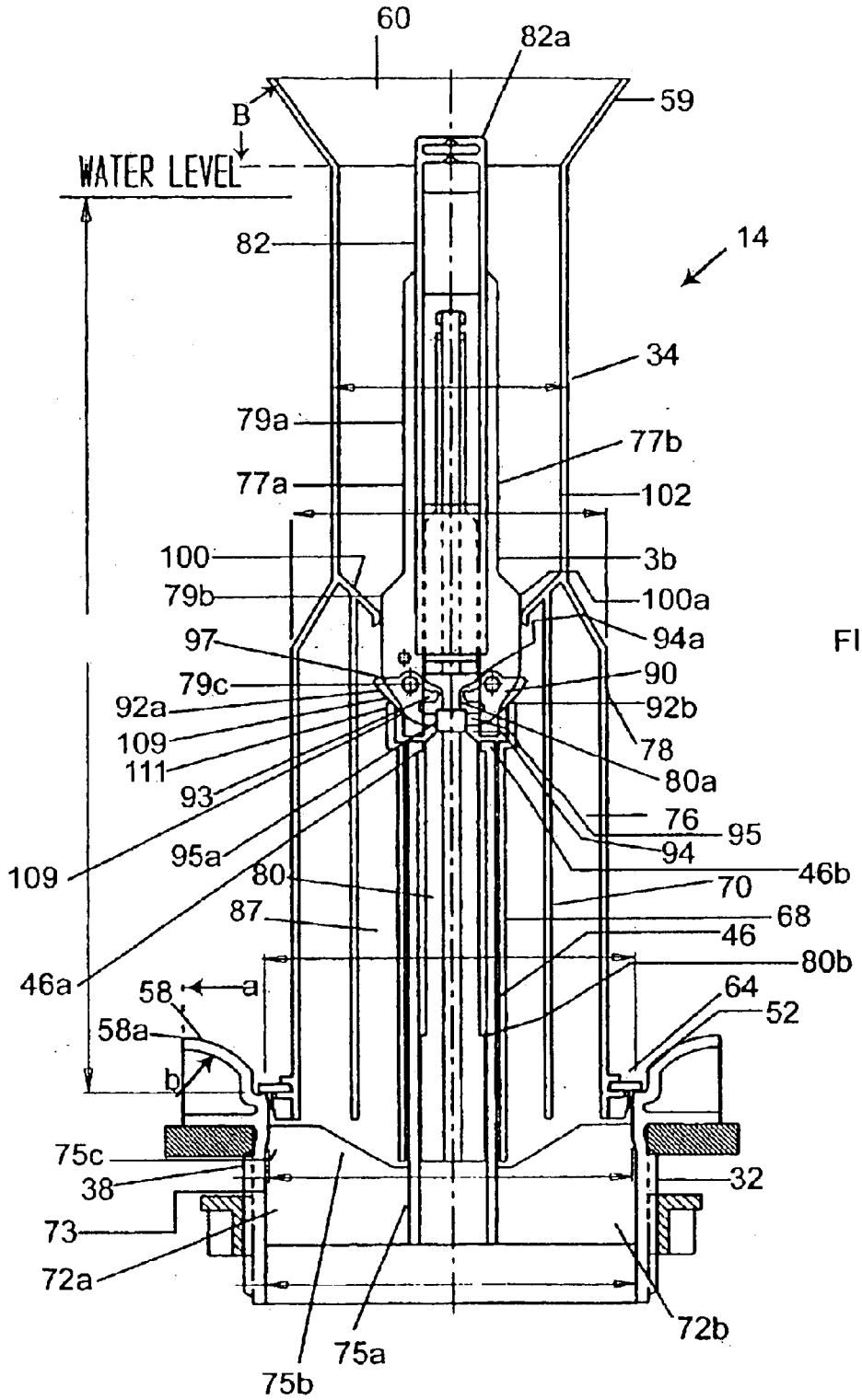
FIG. 7 is a front plan view of the flush valve assembly of FIG. 4.

In accordance therewith, in the flush valve assembly 14 incorporated in the toilet of the present invention, an annular valve seat 52 is provided downstream of the radiused inlet 58 in the flush water discharge opening 61. As best shown in FIGS. 6 and 7, the annular sealing member 64 is provided along the outer circumferential surface 63 of the flush valve cover 34 which rests in the indented annular valve seat 52 when the flush valve cover 34 is in its first rest position In order to properly guide and align the flush valve cover 34 with respect to the valve body 32 when the flush valve cover 34 is moved between its first rest and second upper position, the flush valve cover 34 includes a second inner cylindrical tube member 68 secured to the inner peripheral surface of an inner downwardly depending vertical wall member 70 of the flush valve cover 34 by means of a plurality of radially disposed web members (not shown) bridging the second tube member 68 between the inner wall member 70 and the second cylindrical tube member 68. The second cylindrical tube member 68 is fitted over the first cylindrical tube member 46 of the valve body 32 so that the flush valve cover 34 is properly guided and accurately aligned with the valve body 32 when the flush valve cover 34 is moved between its first rest position and second upper position.

This guiding assembly consisting of the first and second cylindrical tube members 46 and 68, respectively, also assists in properly sealing the valve opening 50 when the flush valve cover 34 is returned to its first rest position. The guiding assembly assures that the annular sealing member 64 fitted over the flush valve cover 34 is properly seated on the annular valve seat 52 of the valve body 32 in the first rest position of the flush valve cover 34.

In order to reduce hydraulic losses and further improve flow characteristics of the flush valve assembly 34, the valve body 32 includes structure to minimize flow resistance. This flow resistance minimization member includes a plurality of tapered web members 72*a*, 72*b*, 72*c* radially disposed between the first cylindrical tube member 46 and an inner peripheral portion 73 of the base sleeve portion 38 of the valve body 32. As is best shown in FIG. 7, each tapered web member 72*a*, 72*b*, 72*c* is formed of a lower height section 75*a* at an end toward the first cylindrical tube member 46 which increases in height through a tapered section 75*b* until reaching extended height section 75*c* at an end toward the inner peripheral surface 73 of the base sleeve portion 38. With this design, turbulence of the flush water passing through the valve discharge opening 61 is minimized.

Hydraulic losses can also result if the flush water does not flow in a laminar manner. Laminar flow can be disrupted by backflow of water within the flush valve assembly 14. In order to reduce backflow of the flush water during the flushing operation, adequate flotation of the flush valve cover 34 must be provided so that the flush water will drain properly.

In order to provide flotation of the flush valve cover 34 when the flush valve cover 34 is moved from its first rest position to its second rest position so as to achieve proper flush water drainage, a flotation cavity 76 is formed between the downwardly depending inner and outer wall members 70 and 78, respectively, of the flush valve cover 34.

As in typical flush valve assemblies, the flush valve cover 34 is initially moved from its first rest position, wherein the valve opening 50 is closed, to a second position, wherein the valve opening 50 is opened by means of a flush lever 18. This flush lever 18 is displaceable by a user between a first rest position and a second position to operatively move the flush valve cover 34 between its first rest position and second upper position. Current agency requirements mandate that the minimum "hold-down" time for the flush lever is one second. However, the longer the valve opening remains open before water is evacuated from the tank, the more energy is dissipated during the flush cycle.

The flush valve assembly of the present invention can achieve closure of the valve opening 50 in less than 1 second, preferably in 0.5–0.6 seconds, to increase the available hydraulic energy of the flush water and thereby ensure a relatively rapid delivery of a predetermined quantity of flush water without exceeding agency requirements. In accordance therewith, the flush valve assembly 14 includes a "trip-release" or "lost-motion" mechanism 36 which, as described below, releases the effect of the flush lever 18 on the flush valve cover 34 when the flush valve cover 34 reaches its second position so as to return the flush valve cover to its first rest position prior to the flush lever 18 returning to its first rest position.

As is shown in the figures, the trip release mechanism 36 includes a cam rod 80, a pull rod 82 operatively connected to the flush lever at end 82*a* and slidably mounted with respect to the cam rod 80 so that the pull rod 82 and the cam rod 80 are moveable in response to movement of the flush lever. A trip dog assembly 90 is also incorporated in the trip release mechanism 36 which is capable of engaging the flush valve cover 34 when the pull rod 82 and cam rod 80 are moved between a first rest position and a second predetermined position and is capable of disengaging the flush valve cover 34 when the pull rod 82 moves beyond its second predetermined position.

Figure 10:
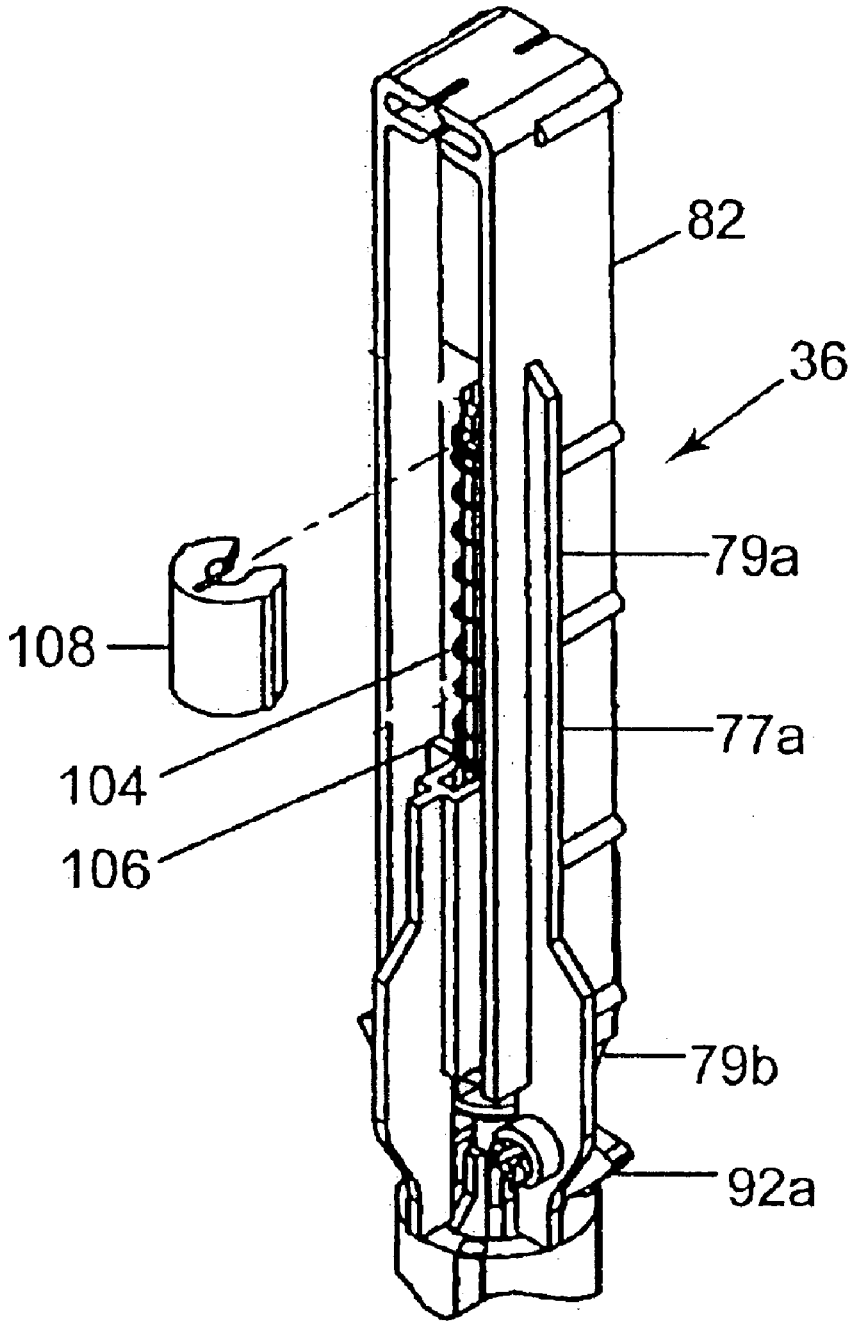
FIG. 10 is a front perspective view of the trip release mechanism of the flush valve assembly of FIGS. 4–5.

As is best shown in FIGS. 6, 7 and 10, the pull rod 82 includes a plurality of extension members, such as 77*a* and 77*b*, which includes a narrow width section 79*a* gradually increasing in width to a raised width section 79*b*. The raised width members 79*b* extend outwardly to an extent such that they can be received within a receiving opening 100*a* formed by the inner peripheral surface of an annularly inclined baffle 100, to be explained in more detail below. Each of the raised width members 79*b* include an engaging hole 79*c* at a lower end thereof.

Figure 9:
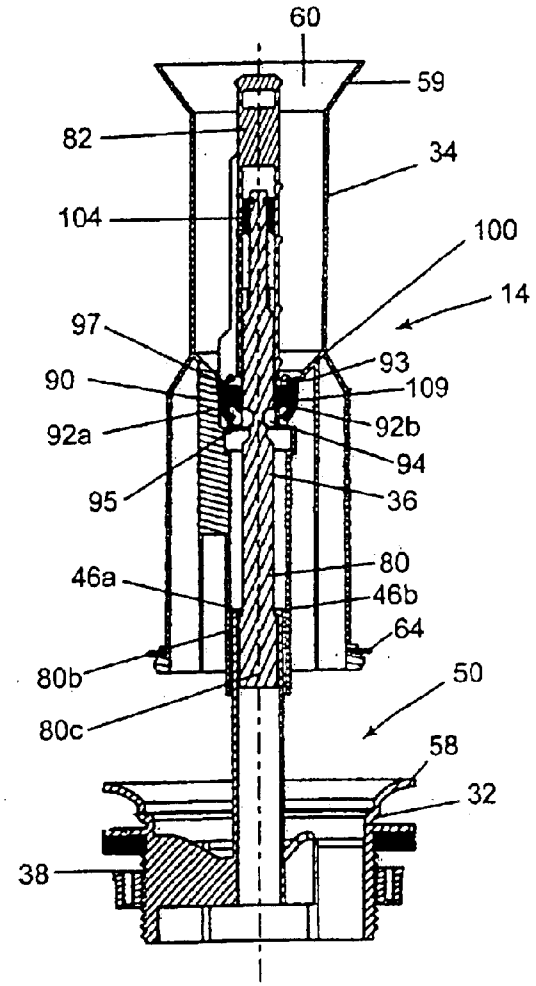
FIG. 9 is a front sectional view of the flush valve assembly of FIG. 5 with the valve opening in its open position.
Figure 8:
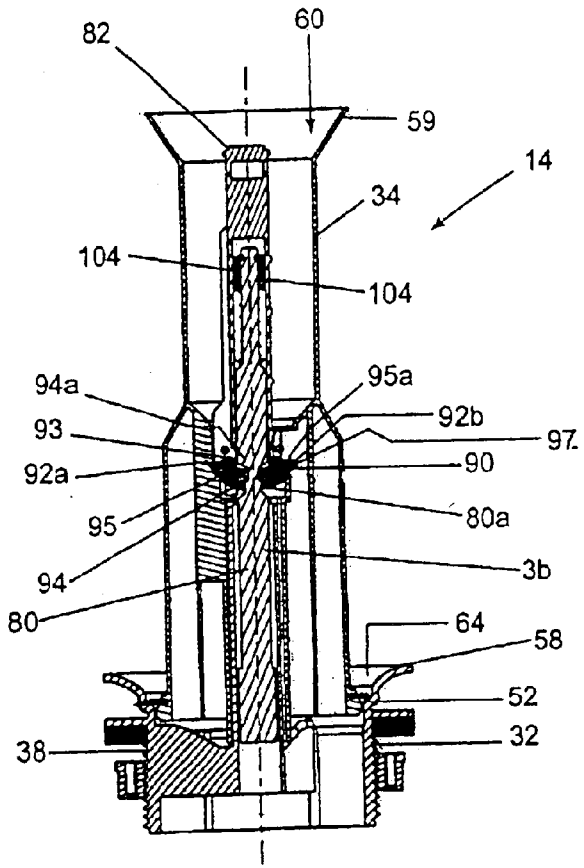
FIG. 8 is a front sectional view of the flush valve assembly of FIG. 4 with the valve opening in its closed position.

The engaging and disengaging members of the trip dog assembly 90 include wing-like retention members 92*a*, 92*b* which are supported in the engaging holes 79*c* of the raised width members 79*b* of the extension members 77*a* and 77*b*. As is shown in FIG. 8, the wing-like retention members 92*a*, 92*b* extend outwardly to engage the flush valve cover 34 when the cam rod 80 and the pull rod 82 are moved together between their first position and the second predetermined position so as to move the flush valve cover 34 between its first rest and second positions. Further movement of the cam rod 80 is restricted past this second predetermined position as will be described in further detail below. With the movement of the cam rod 80 so restricted, FIG. 9 illustrates that the wing-like retention members 92*a*, 92*b* retract when the pull rod 82 is moved past the second predetermined position so as to disengage the wing-like retention members 92*a*, 92*b* from the flush valve cover 34 which in turn allows the flush valve cover 34 to return to its first rest position.

More specifically, as shown in FIGS. 6 and 8, in the first rest position of the cam rod 80 and the pull rod 82, a first catch member 93 of each wing-like retention member 92*a* and 92*b* abuts against a leading inclined surface 94*a* of a central depression cam section 94 of the cam rod 80. The leading edge 95*a* of a second catch member 95 of the wing-like retention members 92*a*, 92*b* abuts against a reduced diameter section 80*a* of the central depression cam section 94 of the cam rod 80.

Each of the wing-like retention members 92*a*, 92*b* further include an engagement section 97 which is pivoted to extend outwardly and be thereby repositioned when the cam rod 80 and pull rod 82 are returned to their first rest positions. As the flush lever 18 initially moves the cam rod 80 and the pull rod 82 from their initial rest positions, the first and second catch members 93 and 95 of the wing-like retention members are contained within the central depression cam section 94 of the cam rod 80. Upon further combined movement of the cam rod 80 and the pull rod 82 due to further depression of the flush lever 18, the engagement section 97 of each retention member 92*a* and 92*b* is engaged with annularly inclined baffle member 100 (see FIG. 7) extending from an inner peripheral surface 102 of the flush valve cover 34 to raise the flush valve cover 34 from its first rest position, wherein the flush opening 50 is closed, to a second upper position, wherein the flush opening 50 is opened. When the cam rod 80 and the pull rod 82 have been moved to the second predetermined height position upon depression of the flush lever 18, an extended annular base flange 80*b* provided on a base section 80*c* of the cam rod 80 abuts against an inwardly extending flange 46*a* provided at the top end 46*b* of the first cylindrical tube member 46 of the valve body 32 (see FIG. 9). This restricts further movement of the cam rod 80 with the pull rod 82 as the flush lever 18 is further depressed.

When the pull rod 82 is moved past this second predetermined position by further depression of the flush lever 18, the pull rod 82.is subjected to additional bias force being applied by a spring member 104 which is fitted over an upper portion of the cam rod 80 and loaded between a central core member 106 of the pull rod 82 (see FIGS. 7 and 10) and a spring knob 108 provided at an upper end of the cam rod 80 (see FIG. 10). Since the cam rod 80 is prevented from further movement, when the pull rod 82 is moved past the second predetermined height position and the biased force begins to be applied thereto, the first and second catch members 93 and 95 ride out of the central depression cam section 94 of the cam rod 80. This, in turn, causes the wing-like retention members 92*a* and 92*b* to pivot (see FIG. 9) such that the engaging sections 97 of the retention members 92*a* and 92*b* are retracted toward the pull rod 80 and disengaged from the annularly inclined baffle member 100 of the flush valve cover 34. As a result, since the flush lever 18 is connected to the pull rod 82, the flush valve cover 34 is no longer under the effect of the flush lever 18. Since the flush valve cover 34 is unrestrained, the flush valve cover 34 is capable of returning to its first rest position. The pull rod 82 continues its upward movement past the second predetermined position until the central core member 106 abuts against the spring knob 108. At this point, further movement of the pull rod 82 is restricted.

This flushing operation causes closure of the valve opening in approximately 0.5–0.6 seconds providing a relatively quick flush operation which causes reduced energy dissipation of the flush water during the flushing operation. Even though the flush valve cover 34 returns to its first rest position to close the valve opening 50, the pull rod 82 continues to move upwardly until the flush lever 18 has complied with its mandatory 1 second "hold-down" time.

In addition, the second cylindrical tube member 68 of the flush valve cover 34 includes an annular extended flange 111 at the upper end thereof (see FIG. 7). When the cam rod 80 and the pull rod 82 are returned to their first rest position in a subsequent flushing operation and the effect of the flush lever is released, the camming surfaces 109 of the retracted wing-like retention members 72*a* and 72*b* abut against the annular extended flange 111 of the second cylindrical tube member 68. As the camming surfaces ride thereover, the wing-like retention members 92*a*, 92*b* are cammed to an extended engageable position so that the first catch member 93 of each wing-like retention member 92*a* and 92*b* abuts against the leading inclined surface of the central depression cam section 94 of the cam rod 80 and the wing-like retention members 92*a* and 92*b* are pivoted into a position whereby the engaging member 97 is capable of engaging the annularly inclined baffle member 100 of the flush valve cover 34 in a subsequent flush operation.

By including the "trip-release" or "lost-motion" mechanism 36 in combination with the other features set forth above, the flow characteristics of the flush water and flow capacity of the flush valve assembly are improved while at the same time compliance with mandated agency requirements is achieved.

Figure 11:
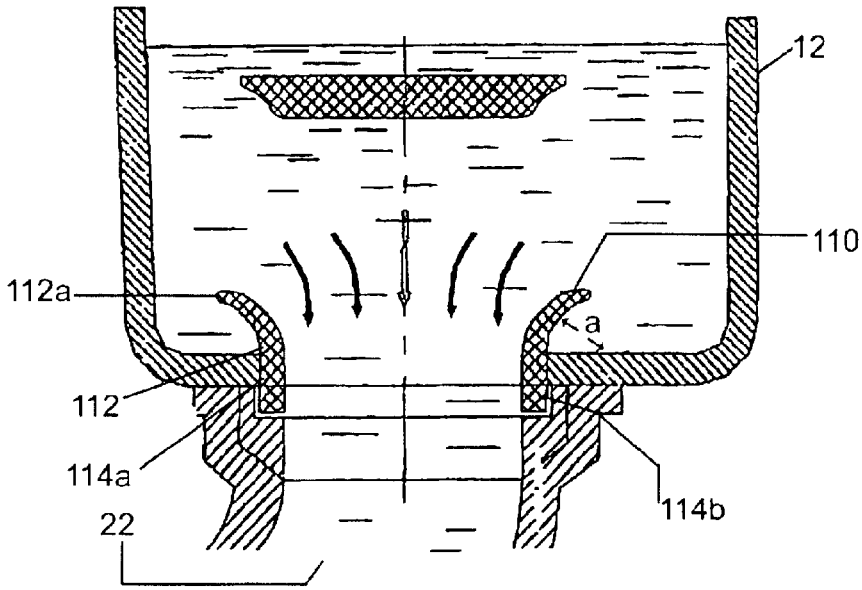
FIG. 11 is a front elevational view of the water valve inlet between the water tank and the toilet bowl of the toilet of FIG. 1.

FIG. 11 illustrates a sweep inlet 110 providing a transition between the water tank 12 and the transition pathway 22 so as to maximize throughput energy of the flush water passing into the transition pathway 22 which in turn creates more available energy to remove waste from the toilet bowl. As shown in FIG. 11, the sweep inlet 110 has a radiused port 112 at one end thereof having an inclined leading edge 112*a*, similar to the radiused inlet 58 of the base sleeve portion 38 of the flush valve assembly of FIGS. 4–9. The radiused port 112 has a diameter of preferably approximately 4 inches which tapers to a narrowed diameter of 3 inches between the side walls 114*a* and *b*. The leading edge 112*a* is inclined to the horizontal axis of the water tank 12 at a lead-in angle $\alpha$.

As a result of this valve inlet design, the discharge coefficient of the flush valve is increased to approximately 0.95. By increasing the discharge coefficient, the hydraulic energy of the water passing through the flush valve is increased. As a result, the hydraulic losses of the flush water passing from the tank to the rim and jet supply channels are reduced such that more energy is created in the flush water to remove waste in the toilet bowl.

Figure 12:
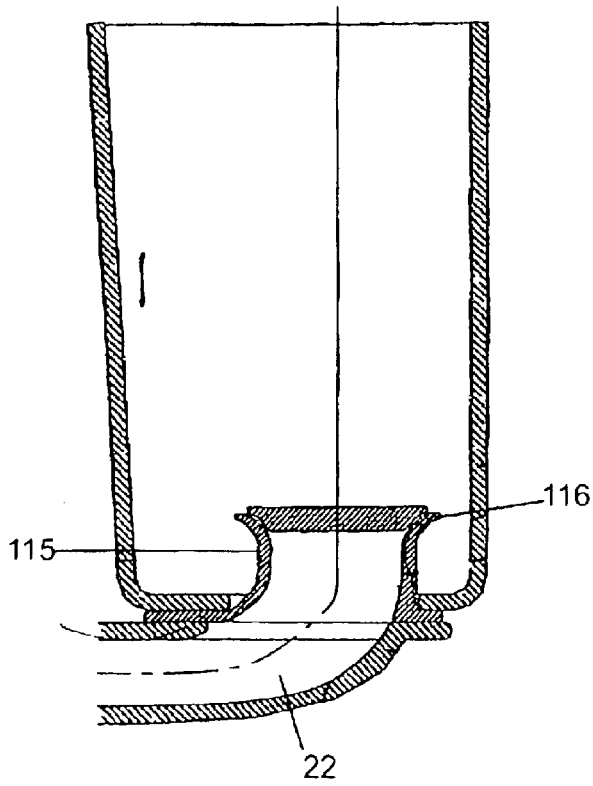
FIG. 12 is a side elevational view of the water valve inlet of FIG. 11.

FIG. 12 is another arrangement for a flush valve with improved hydrodynamics. This flush valve embodiment also includes a valve inlet 115 having a radiused port 116 but does not require elevation of the platform for the water tank as in the valve inlet 110 of FIG. 11. Due to the lack of elevation of the platform for the water tank, in order to provide adequate sealing, the valve inlet 115 is made of molded rubber.

The piers of FIGS. 11 and 12 are set forth herein for illustrative purposes. These designs provide for a delivery rate of approximately 7.5 liters/sec. into the transitional pathway 22. As would be readily known to one skilled in the art, a flush valve cover, such as in the flush valve assembly of FIGS. 4–9 can be used in conjunction with either of these valve inlets 110 and 115. Alternatively, other known flush valve assemblies can be adapted to be used in conjunction with these pier concepts.

Figure 13:
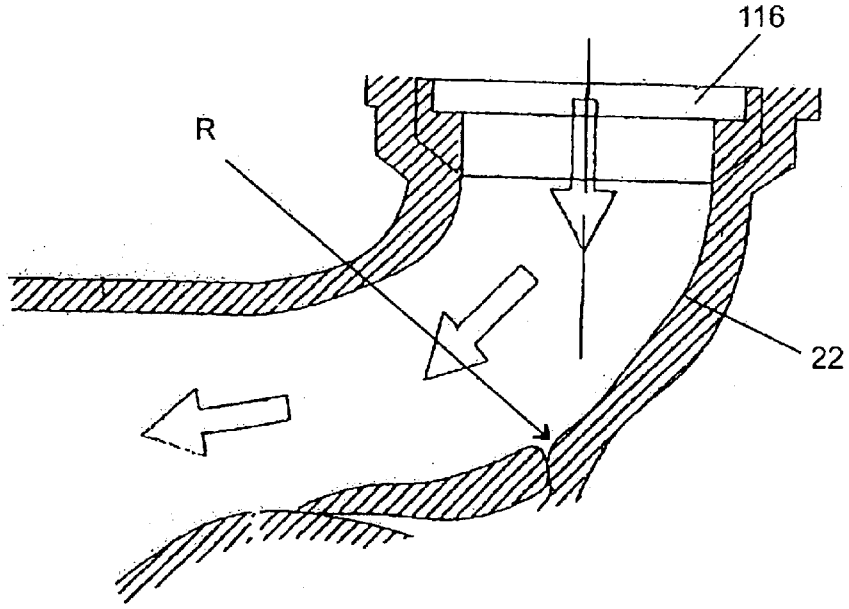
FIG. 13 is a side elevational view of the water pathway or conduit leading from the water tank to the toilet bowl in the toilet of FIG. 1.

FIG. 13 illustrates the transitional pathway or sweep elbow 22 leading from the flush valve assembly of the water tank 12 to the rim channel 24 and direct water channel 29. As shown in FIG. 13, the radius R of the sweep elbow 22 is at least 3 inches, that is, the radius R must be at least equal to the narrowed diameter of the radiused inlet. At the inlet end 116 of the transitional pathway 22, the flush valve assembly, such as 14 herein will be fitted with a radiused horn (not shown). The transitional pathway 22 is preferably made of chinaware and thus provides for the smooth transition of the flow of the flush water from the flush valve 12 to the rim channel 24 and the direct water jet channel 29. Therefore, in conjunction with the flush valve assemblies with radiused inlet as set forth above, a "sweeping" flow path is provided to deliver flush water volume with increased energy to the rim channel 24 and direct jet channel 29.

As aforementioned, the flush water delivered from the transitional pathway 22 either passes into the rim channel 24 or the direct water jet channel 29 provided at the back section of the toilet bowl. As best shown in FIGS. 1and 3, the water jet channel 29 is relatively large preferably (1 ⅝" diameter) such that a concentrated stream of flush water is directed into the siphon jet 30 at the base of the toilet bowl (see arrow C in FIG. 3). Since this toilet has a single side jet feed, hydraulic losses of the flush water are reduced in comparison to a toilet design having jet ports on both sides of the toilet bowl thereby leading to enhanced flush performance. In the typical flush, 2.6 liters of water passes through the direct jet channel 29.

FIGS. 1 and 3 illustrate that the flush water flows through the spiral rim channel 24 in an unrestricted supply path which is asymmetric and unidirectional. In order to create balanced flow of the flush water between the rim channel 24 and the direct jet channel 29, approximately 1.7 liters of water passes through the rim channel 24 during each flush operation. In the preferred embodiment, the rim cross section is approximately 1 ¼"×1½".

Figure 14:
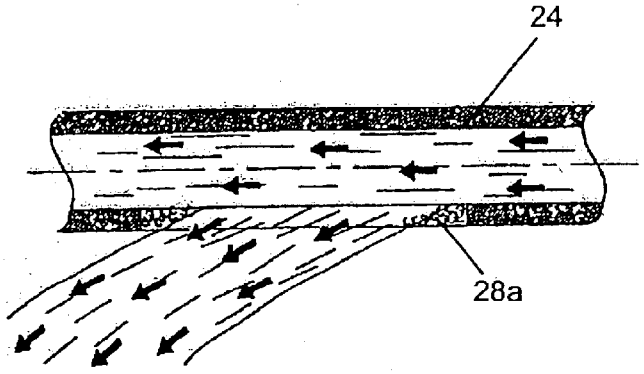
FIG. 14 is a side elevational view of the bowl rim of the toilet of FIG. 1 and specifically illustrates a water slot provided in the bowl rim through which flush water passes.

As described above, the rim channel 24 has two water discharge slots 28*a* and *b*, such as the discharge slot shown in FIG. 14. As is shown in FIGS. 1 and 3, one of the discharge slots 28*a* is provided at a front section 117 of the rim channel 24 and has a preferred dimension of approximately 3"×⅝" and the second discharge slot 28*b* is provided at a rear end section 118 of the rim channel 24 and has a preferred dimension of approximately 4"×1". The flush water is discharged through the first and second discharge slots 28*a* and 28*b* in two powerful streams to generate a strong vortex action in the sump. This vortex action, in combination with the action of the water jet delivered from the jet channel 29 and the siphon vacuum, leads to a quicker and more complete removal of waste from the toilet bowl as well as provides an efficient bowl cleaning operation.

Figure 15:
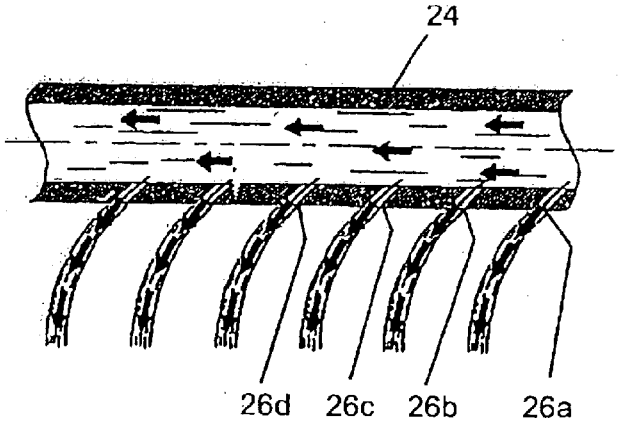
FIG. 15 is a side elevational view of the bowl rim of the toilet of FIG. 1 and specifically illustrates the rim holes provided therein through which water passes.

As is shown in FIGS. 3 and 15, the rim channel 24 also includes a plurality of rim openings, such as 26*a, b, c* and *d*. In the preferred embodiment, twenty five rim openings are distributed evenly throughout the whole perimeter of the rim channel 24. Each of the rim openings 26*a, b, c* and *d* has a diameter of approximately 7/32" with a pitch of approximately 1½". The flush water passing through the rim openings 26*a, b, c* and *d* pre-wets the whole perimeter of the toilet bowl 12. Although energy is dissipated in the flush water passing through the rim openings 26*a, b, c* and *d*, this water still contributes additional energy to the creation of a strong vortex in the sump of the toilet bowl to efficiently and quickly remove waste.

In this cleaning process as described above, the sides of the bowls are pre-wetted due to the water passing through the rim openings 26*a, b, c* and *d*. In addition, the strong vortex action created by water passing through the siphon jet 29 and the discharge slots 28*a* and *b* efficiently washes the walls of the toilet bowl.

Figure 16:
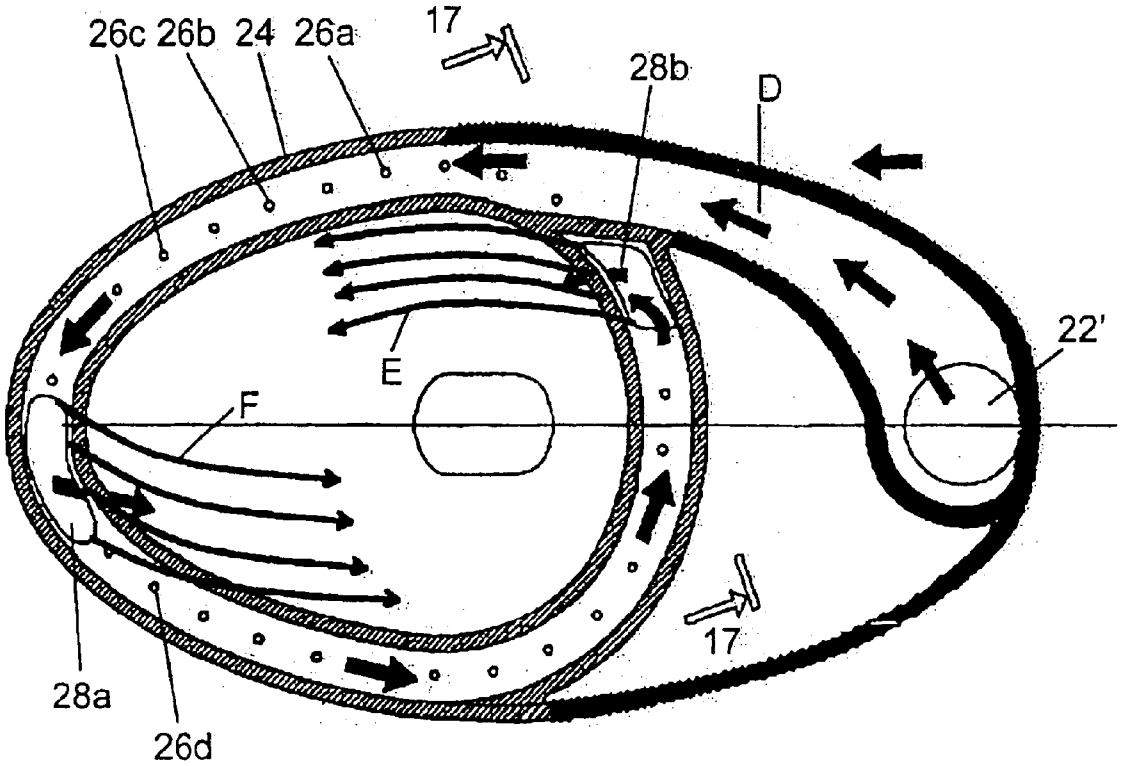
FIG. 16 is a top elevational view illustrating the flush water flow through another preferred embodiment of a rim path for a toilet in accordance with the teachings of the present invention.

FIG. 16 illustrates in more detail the flush water flow through the rim channel 24, and more particularly, the side entry of the water flow from the transitional pathway 22' to the rim channel 24, as shown by arrows D. FIG. 16 further illustrates that a strong vortex action can be achieved if the flush water is discharged from the rim channel 24 into the toilet bowl 20 by concentrated water streams, such as the water streams depicted by arrows E and F. These two streams E and F compensate for each other and create a strong but yet non-turbulent vortex action in the toilet bowl. The two steams E and F are formed by flush water' being discharged through the pair of water discharge slots 28*a* and 28*b* provided in the rim channel 24. FIG. 16 illustrates that one of the discharge slots 28*a* is provided in the middle of the rim channel path at the front of the toilet bowl and the other discharge slot 28*b* is formed at the terminus of the spiral of the rim channel 24. By providing the second and last discharge slot at the end of the rim channel 24, water reliably flows in a sufficient amount through the plurality of rim openings, such as 26*a, b, c* and *d* such that the whole perimeter of the toilet bowl is cleared. It has been found that providing two concentrated streams of water, such as water streams E and F, enhances the efficiency of the flush and reduces energy losses.

Figure 17:
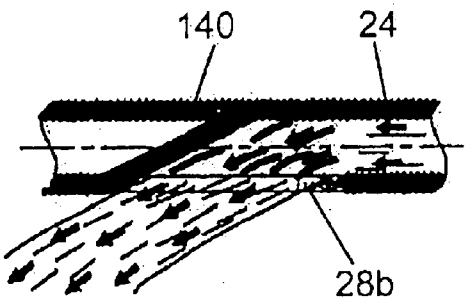
FIG. 17 is a side elevational view of the bowl rim of the toilet of FIG. 16 taken along line 17—17 of FIG. 16.

Moreover, in the design of this toilet, applicants have found that it is advantageous to obtain unrestricted continuation of the water stream after the flush water is discharged from the rim channel 24. This objective can be achieved by forming a smooth sloped end wall, such as 140 (see FIG. 17) at the back end of the final discharge slot 28*b*. If wall .140 was vertical instead of sloped, horizontal water flow is significantly retarded and kinetic energy is lost.

Figure 19:
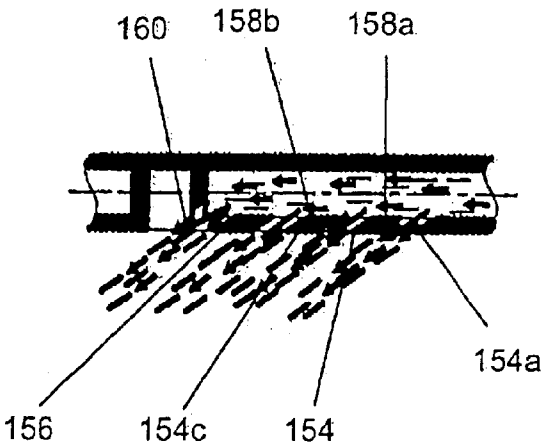
FIG. 19 is a side elevational view of the bowl rim of the toilet of FIG. 18 taken along line 19—19 of FIG. 18.
Figure 18:
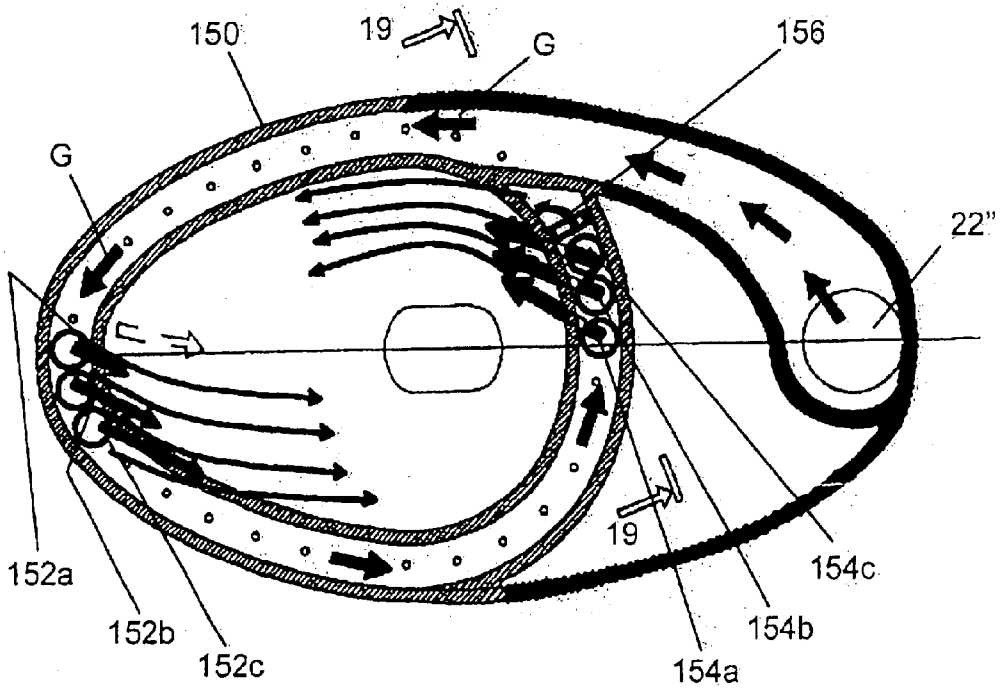
FIG. 18 is a top elevational view illustrating the flush water path through another preferred embodiment of a rim path for a toilet in accordance with the teachings of the present invention.

FIGS. 18 and 19 illustrate another preferred embodiment of the configuration of a rim channel 150 for the toilet assembly of the present invention. In this embodiment, the flush water enters the rim channel 150 from the transitional pathway 22" at a side thereof. The flush water flows around the rim channel 150 in the direction of arrows G in FIG. 18 in a path which is asymmetric and unidirectional. Along this path, a first set of rim openings 152*a, b* and *c*, preferably three in number, are provided in the middle of the rim channel path at the front of the toilet and a second set of rim openings 154*a, b* and *c* are provided at the end of the spiral rim path. A water discharge slit 156 is also formed in the rim channel 150 after the last of the second set of rim openings 154*c*.

In this embodiment (FIG. 18), the rim openings 152*a, b* and *c* and 154*a, b* and *c* are relatively large and located close to each other. The narrow walls (see 158*a*, 158*b*) between the rim holes provide rigidity in the vertical direction and reduce distortion of the water flow. In total, the combined area of the rim openings 152*a, b*, and *c* and 154*a, b* and *c* should be approximately equal to the respective water discharge slots 28*a* and *b* in the embodiment of FIG. 3. By providing two sets of rim openings as shown in FIG. 18, a strong vortex action of the flush water is obtained with an even water level being distributed along the perimeter.

In the rim channel 150 of FIG. 18, unrestricted continuation of the water stream is achieved after the flush water has completed the entire rim path of the rim channel 150 by forming the water discharge slit 156 in a vertical wall 160 of the rim channel 150. As a result, flush water discharged through the water discharge slit 156 continues to flow in a horizontal direction and consequently does not lose kinetic energy as would result if the flush water impinged upon a vertical wall after complete flow through the rim channel 150.

Figure 20:
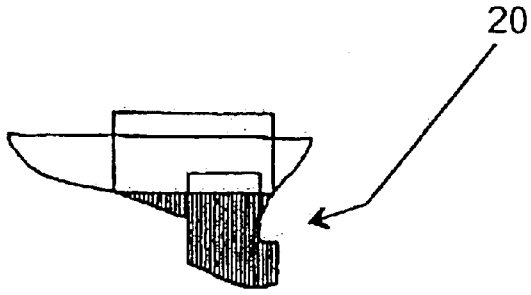
FIG. 20 is a side view of the toilet bowl of the toilet of FIG. 1 filled with water.

FIG. 20 illustrates the configuration of the toilet bowl 20. FIGS. 20 illustrates that the toilet bowl 20 has sufficient depth and is wide enough to have a large enough water spot so as to not collect too much water.

Figure 21:
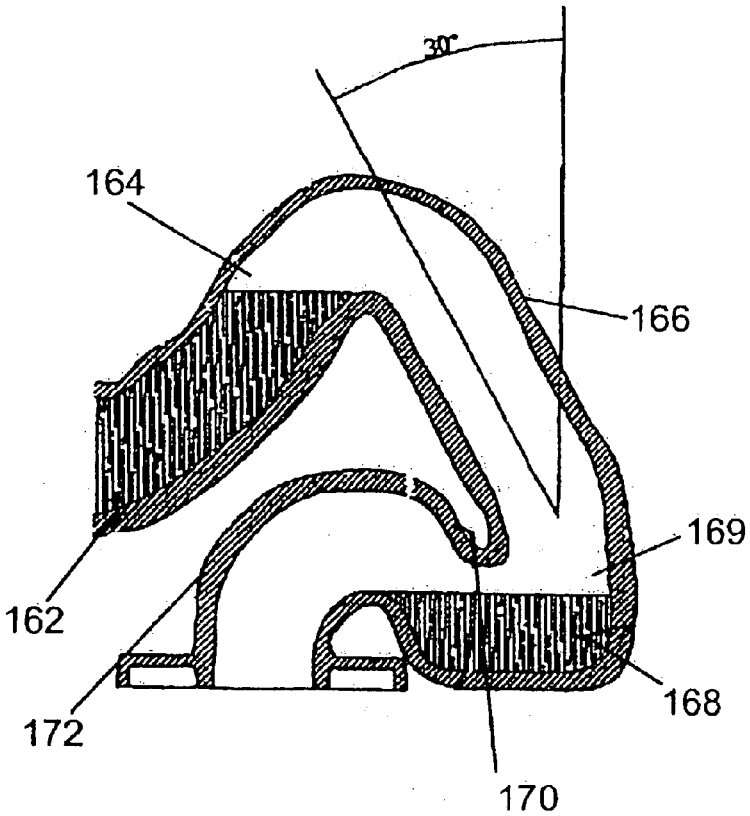
FIG. 21 is a side elevational view of the siphon and trapway conduits of the toilet of FIG. 1.

At the completion of the flush process, the flush water and waste material pass through the siphon jet 30 into the trapway 40 which leads to the sewage line. As is shown in FIG. 1, the trapway 40 has a first weir area 162 which connects to a first upwardly inclined trapway section 164. The length of the first trapway section 164 is minimized such that the standing water in the sump, first weir area 162 and first trapway section 164 is approximately 0.475 liters (see FIG. 21). The first trapway section 164 leads to a downwardly inclined second trapway section 166 which, as shown in FIG. 21, has a slope which is directed to the bowl at an angle of approximately 30°. A second weir area 168 is provided at a discharge end 169 of the second trapway section 166. The trapway 40 next slopes upwardly in a third trapway section 170 which connects to a generally vertically oriented and downwardly depending fourth trapway section 172 which is connected to the sewage line 31. In the preferred embodiment, the toilet bowl 20 and trapway 40 store approximately 1.9 liters of water.

In accordance with one of the advantages of the present invention, the trapway 40 has no reduction in cross-section throughout its entire length. In one preferred embodiment, each of the sections of the trapway 40 has a diameter throughout its entire length of up to approximately 2.5 inches. As a result, waste which is less than 2 ½" in diameter can pass therethrough without clogging the trapway. Therefore, if any waste material goes into the trapway 40, it passes therethrough because the trapway 40 has no reduction of cross section. If any clogging takes place in the toilet 10 of the present invention, the clogging will occur in the sump and can be easily cleaned without cable or plumber assistance. Moreover, due to the lack of reduction in the diameter of the trapway, an anti-clogging cable can easily pass therethrough. Therefore, the trapway design herein provides for outstanding waste removal capacity. Moreover, this trapway design provides for a discharge rate into the sewage line of 4.2 liters/sec.

Therefore, the total water usage per cycle of this toilet is 5.7 liters with 4.5 liters going into flush and 1.2 liters into refill. The amount of fresh residual water in the sump after a flush operation is 0.7 liters.

Figure 23:
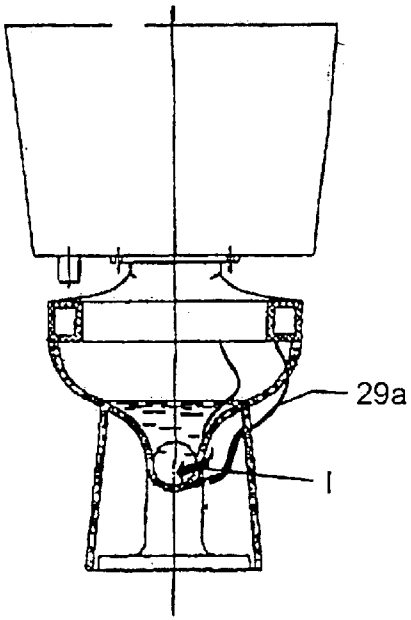
FIG. 23 is a front elevational view of the toilet of FIG. 22.
Figure 22:
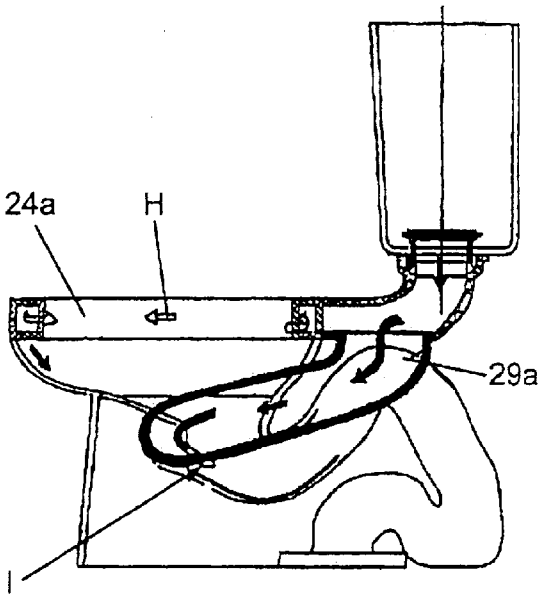
FIG. 22 is a side elevational view of another preferred embodiment of a toilet in accordance with the teachings of the present invention.
Figure 24:
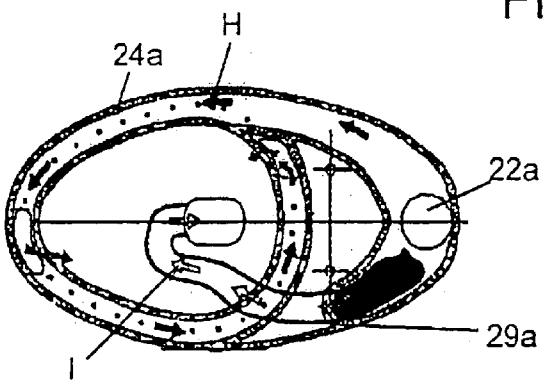
FIG. 24 is a top elevational view illustrating the flush wall flow into the toilet bowl of the toilet of FIG. 22.

FIGS. 22–24 illustrate another:embodiment of a toilet in accordance with the teachings of the present invention which achieves a similar flushing operation to that of FIGS. 1–3. In this embodiment, flush water flows through the rim channel 24*a* (designated by arrow H) and flush water flows through the jet channel 29*a* (designated by arrow I) in opposite directions after being discharged from the transitional pathway 22*a*. Although the flush water paths are directed in this manner, hydraulic losses have been found to be minimal.

Figure 25:
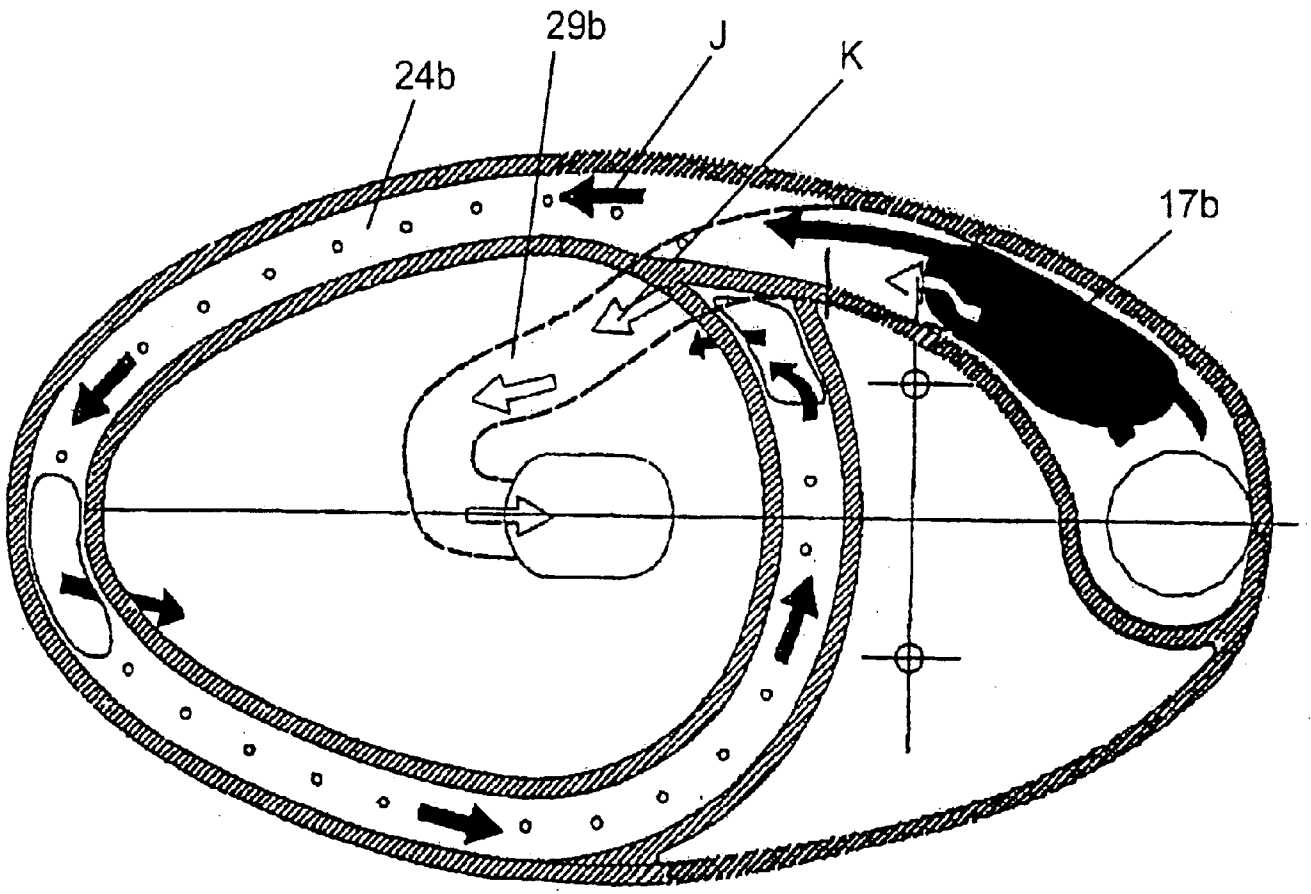
FIG. 25 is a top elevational view of another preferred embodiment of a plastic insert for the direct jet channel to be used in conjunction with the toilets of FIGS. 1 and 18.

FIG. 25 illustrates another water flow path for a toilet in accordance with the present invention wherein water flow is directed in the same direction (see arrows J and K) into the rim channel 24*b* and the direct jet channel 29*b*. In this embodiment, a portion 176 of the transitional pathway 22*b* is formed of a plastic insert.

Figure 26:
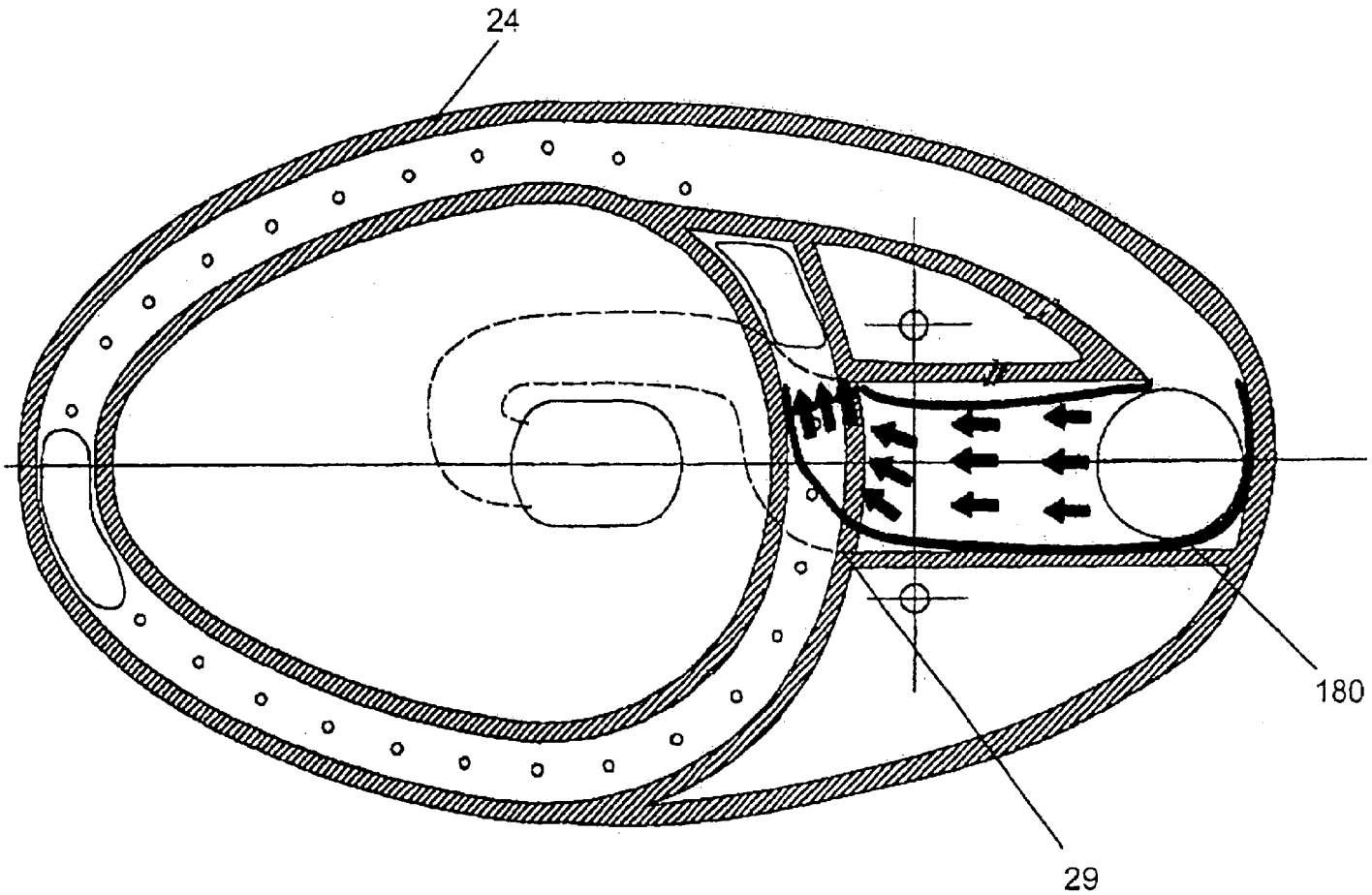
FIG. 26 is a top elevational view of another preferred embodiment of a plastic insert for the direct jet pathway to be used in conjunction with the toilet assembly of the present invention.
Figure 27:
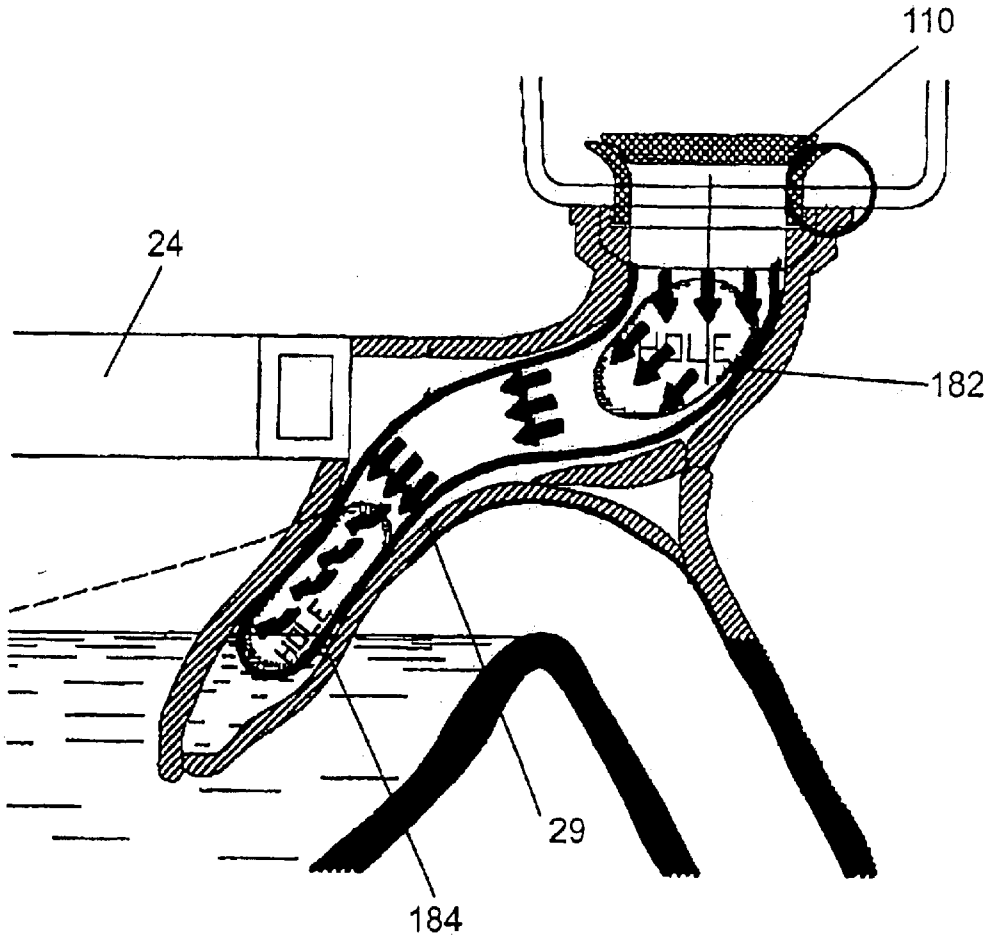
FIG. 27 is a side elevational view specifically illustrating water flow through the plastic insert of FIG. 26.
Figure 28:
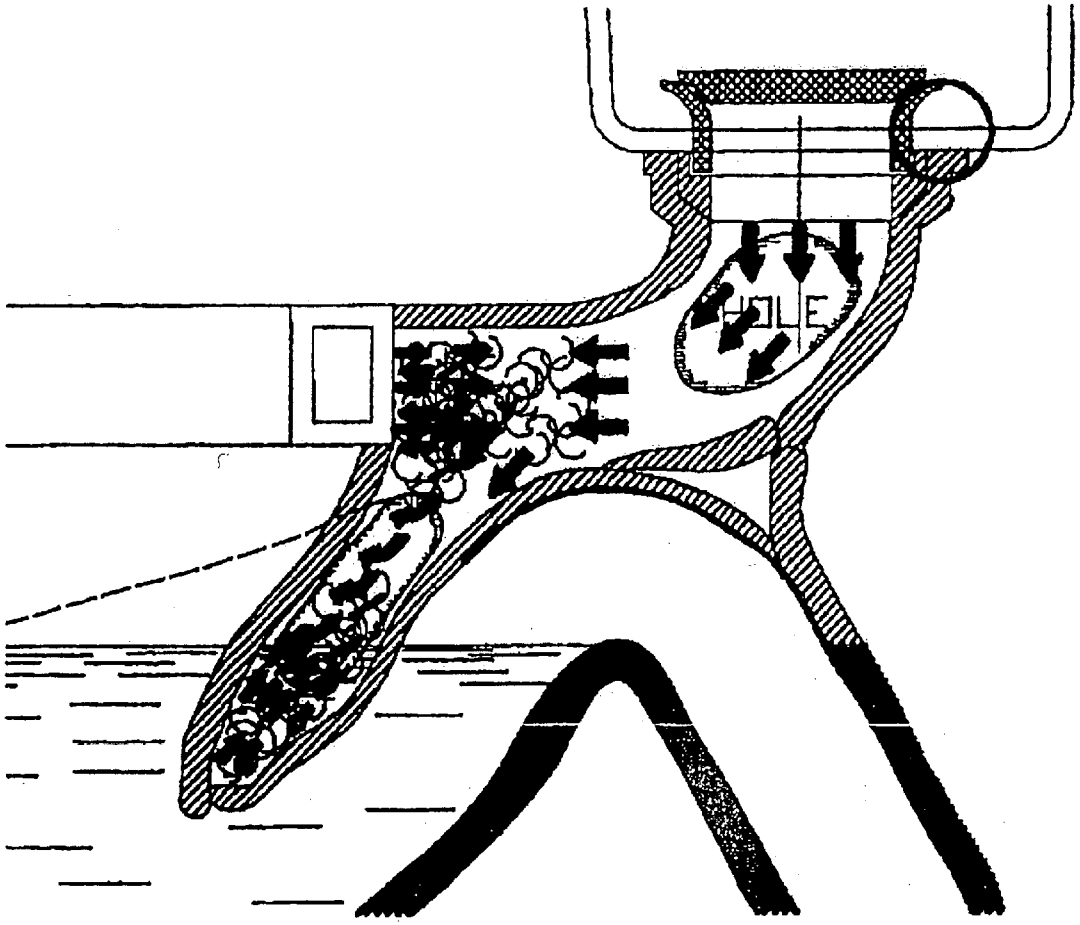
FIG. 28 is a side view specifically illustrating impeded water flow through a direct jet pathway.

FIGS. 26 and 27 illustrate that the transitional pathway and the direct jet pathway are at least in part formed of a plastic insert, such as 180. A first hole 182 is provided in the plastic insert 180 such that flush water is directed to the rim channel 24. A second hole 184 is provided at the end of the insert 180 so that flush water can be directed into the base of the bowl. Hydraulic losses, as appear in the water flow path of FIG. 28, are alleviated by providing a smooth channel, the plastic insert 180, to transfer jet water from the valve inlet 110 to the inlet 184 of the jet channel 29 around the bowl. This smooth non-turbulent flow is enhanced by using plastic, rubber or some other material insert as compared to the more turbulent flow experienced in the water flow path of FIG. 28. By fitting the insert into a finished China toilet, an ease of manufacturing results as well as a more efficient and less expensive assembly.

Figure 29:
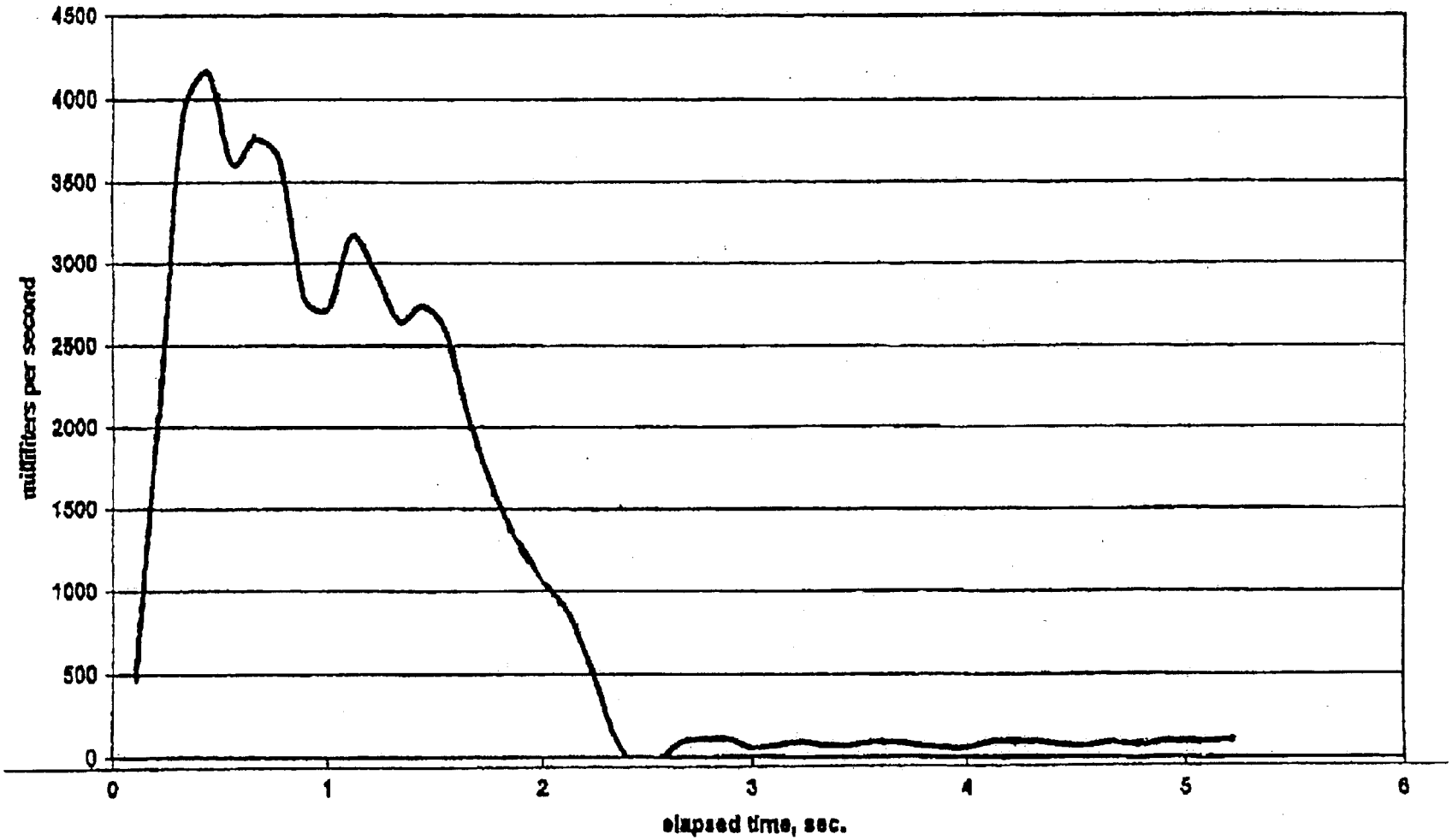
FIG. 29 is a chart representing the flush rate of the toilet of FIG. 1 plotting millimeters/second vs. elapsed time.

Accordingly, for those reasons set forth above, a toilet has been designed which achieves a greater energy throughput in comparison to existing toilets to thereby provide more flush water energy to remove waste from the toilet bowl. In addition, the toilet meets governmental agency requirements which mandate a minimum "hold-down" duration of the flush lever of one second and a maximum water usage of 1.6 gallons (6 liters)/flush. Moreover, the toilet of the present invention enhances the flow characteristics and flow capacity of the flush water and provides a flushing operation which is completed in approximately 2.5 seconds (see FIG. 29). Further, the trapway design of the toilet reduces the chances of clogging.

Although the invention has been particularly shown and described with references to certain preferred embodiments, it will be readily appreciated by those or ordinary skill in the art that various changes and modifications may be made therein without departing from the spirit and scope of the invention. It is intended that the appended claims be interpreted as including the foregoing as well as various other such changes and modifications.

What is claimed is:

1. A water closet comprising:

a toilet bowl assembly having a toilet bowl and a trapway extending from the bottom of the toilet bowl and adapted to be coupled to a sewage line, the toilet bowl having a rim channel along an upper perimetral portion thereof; and a water tank positioned over the toilet bowl assembly adapted to contain water used to initiate the siphoning from the toilet bowl to the sewage line and to refill the toilet bowl with fresh flush water after each flush operation, said water tank having a flush valve assembly comprising a valve body having a base sleeve portion for securement to the water tank and a flush cover member which is coaxially and slidably mounted with respect to said valve body so that a valve opening is created between the valve body and the flush valve cover when the flush valve cover is not seated on the, valve body;

wherein said base sleeve portion of said valve body has an inlet at said valve opening with a radius incorporated onto a leading edge of said inlet to provide a lead-in angle and to thereby increase the water discharge coefficient of the valve opening; and wherein the flush water flows through the rim channel of the toilet bowl assembly in a flow path which is asymmetrical and unidirectional.

* * * * *